US007485790B2

(12) United States Patent
Payerl

(10) Patent No.: US 7,485,790 B2
(45) Date of Patent: Feb. 3, 2009

(54) CAJON

(75) Inventor: Wolfgang Payerl, Münchsteinach (DE)

(73) Assignee: Roland Meinl Musikinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/708,539

(22) Filed: Feb. 21, 2007

(65) Prior Publication Data

US 2008/0083317 A1 Apr. 10, 2008

(30) Foreign Application Priority Data

Oct. 10, 2006 (DE) ..... 20 2006 015 511

(51) Int. Cl.
*G10D 13/02* (2006.01)

(52) U.S. Cl. ..... 84/411 R; 84/411 R; 84/415

(58) Field of Classification Search ..... None
See application file for complete search history.

(56) References Cited

U.S. PATENT DOCUMENTS

| | | | | | |
|---|---|---|---|---|---|
| 478,611 | A | * | 7/1892 | Knittel | 84/416 |
| 1,265,917 | A | * | 5/1918 | Jay | 84/415 |
| 1,490,476 | A | * | 4/1924 | Morris | 340/392.4 |
| 1,505,161 | A | * | 8/1924 | Nickels | 84/27 |
| 1,588,636 | A | * | 6/1926 | Westbrook, Jr. | 84/287 |
| 1,604,657 | A | * | 10/1926 | Pederson | 84/310 |
| 1,722,032 | A | * | 7/1929 | Bower | 84/415 |
| 4,154,137 | A | * | 5/1979 | Kobayashi | 84/411 R |
| 4,246,825 | A | | 1/1981 | Hodas | |
| 5,986,197 | A | * | 11/1999 | Allen | 84/411 M |
| 6,441,287 | B1 | * | 8/2002 | Crouch et al. | 84/415 |
| 6,686,528 | B1 | * | 2/2004 | Dicken | 84/422.3 |
| 6,720,491 | B1 | * | 4/2004 | Kroncke | 84/422.3 |
| 7,223,910 | B2 | * | 5/2007 | Shimada | 84/415 |
| 2007/0056428 | A1 | * | 3/2007 | May | 84/41 |
| 2008/0034944 | A1 | * | 2/2008 | Aspland | 84/415 |
| 2008/0083317 | A1 | * | 4/2008 | Payerl | 84/411 R |

FOREIGN PATENT DOCUMENTS

| | | | |
|---|---|---|---|
| DE | 20 2005 000 987 | U1 | 9/2005 |
| DE | WO 2005116987 A 1 | * | 12/2005 |
| DE | 20 2005 019 423 | U1 | 3/2006 |
| DE | 20 2006 008 418 | U1 | 10/2006 |
| DE | 20 2006 012 202 | U1 | 11/2006 |
| FR | 2 837 318 | | 9/2003 |
| JP | 2006-106225 | | 4/2006 |
| WO | WO 2005/116987 | A1 | 12/2005 |

OTHER PUBLICATIONS

Big Cajones © 2006, testing Apr. 9, 2006, maxkelly. com/features/music/instrument_cajon.html, viewed Mar. 13, 2008.*

How to Build Flamenco Cajon with Plywood, German Ocana © 2004, http://www.davidbruce.net/building_cajon.pdf, viewed Mar. 13, 2008.*

* cited by examiner

*Primary Examiner*—Walter Benson
*Assistant Examiner*—Robert W Horn
(74) *Attorney, Agent, or Firm*—Browdy and Neimark, P.L.L.C.

(57) ABSTRACT

A cajon comprising a cuboid housing made of wood, wherein one side serves as the playing side and wires are strung below the corresponding wooden plate that, when the playing surface is struck, interact with the same and produce a sound effect, wherein each wire has at least one associated damping element.

4 Claims, 2 Drawing Sheets

CAJON

BACKGROUND OF THE INVENTION

1. Field of the Invention

The invention relates to a cajon comprising a cuboid housing made of wood, wherein one side serves as the playing side and wires are strung below the corresponding wooden plate that, when the playing surface is struck, interact with the same and produce a sound effect.

2. Background Art

A cajon of this type is known, for example, from DE 20 2005 019 423 U1.

In the prior art cajon, a textile damping element is provided, which rests directly against the underside of the playing surface.

The damping effect that is created in this manner concerns the vibrations of the striking surface as such.

SUMMARY OF THE INVENTION

With this as the starting point, the invention is based on the object of improving the sound of a generic cajon, which is assumed to be known.

This object is met according to the invention in such a way that each wire has at least one associated damping element. A damping action, therefore, is thereby exerted directly onto the wires, so that the striking surface as such can vibrate freely and only the so-called snare effect is shortened in its duration.

In an additional embodiment of the invention, provision is made for damping elements to be formed in each case at the upper and lower end of each wire.

The damping elements are advantageously composed of a rubber-like, flat material.

The damping elements are advantageously fixed to a surface extending perpendicular to the wires and are bent at right angles in such a way that the free L-shaped leg that does not serve for fastening purposes elastically rests against the corresponding wire end.

At least one end of this wire may be fixed to a tension element, which is displaceable by means of tension adjustment screws in the longitudinal direction of the wires to adjust their pretension.

Damping elements are advantageously also provided in the region of the wire ends on the tension element.

The invention will be explained in more detail below with the aid of a preferred exemplary embodiment in conjunction with the drawing.

DESCRIPTION OF THE PREFERRED EMBODIMENT

Figure 1:
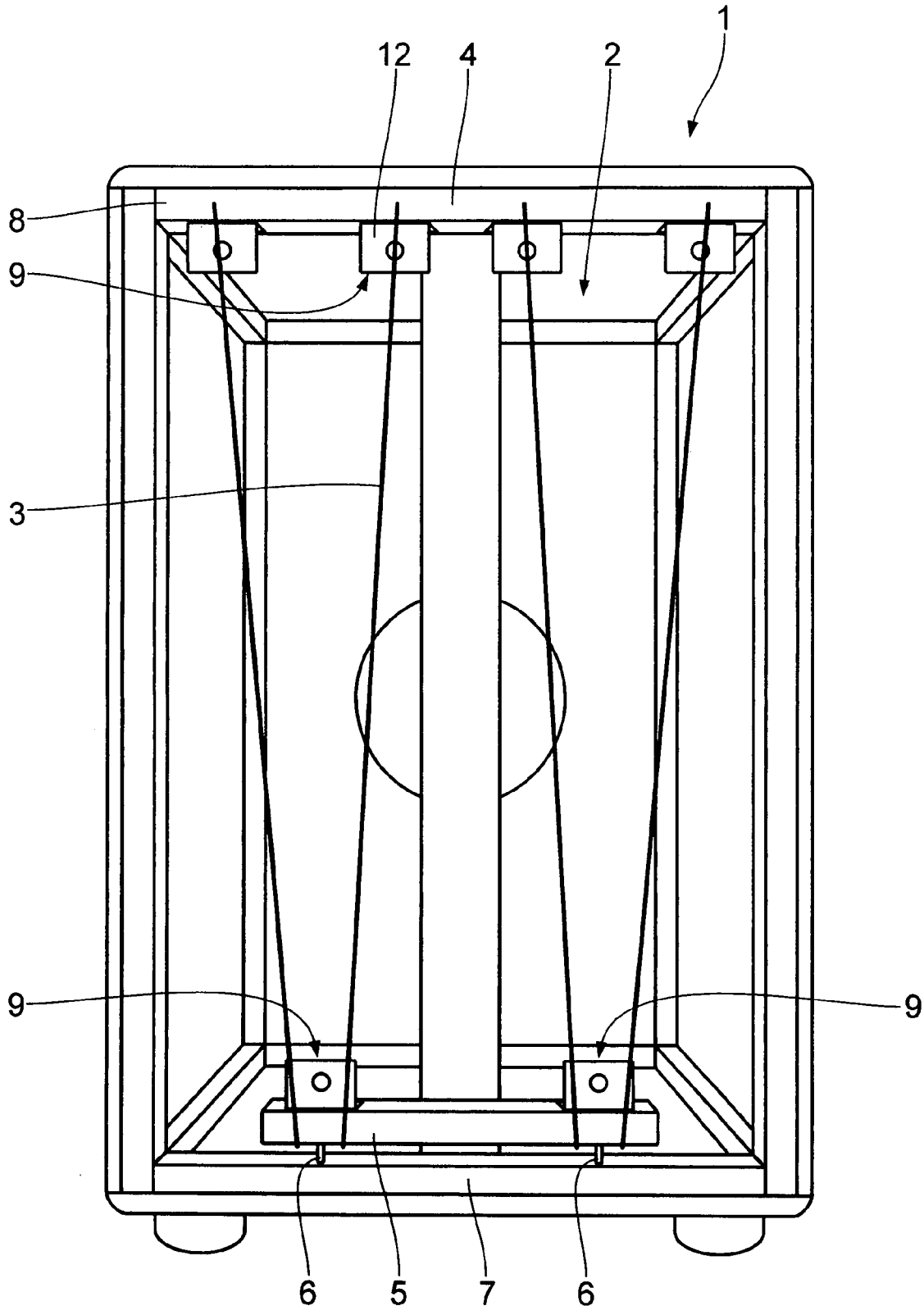
FIG. 1 shows a perspective view of an inventive cajon with the striking plate removed.
Figure 2:
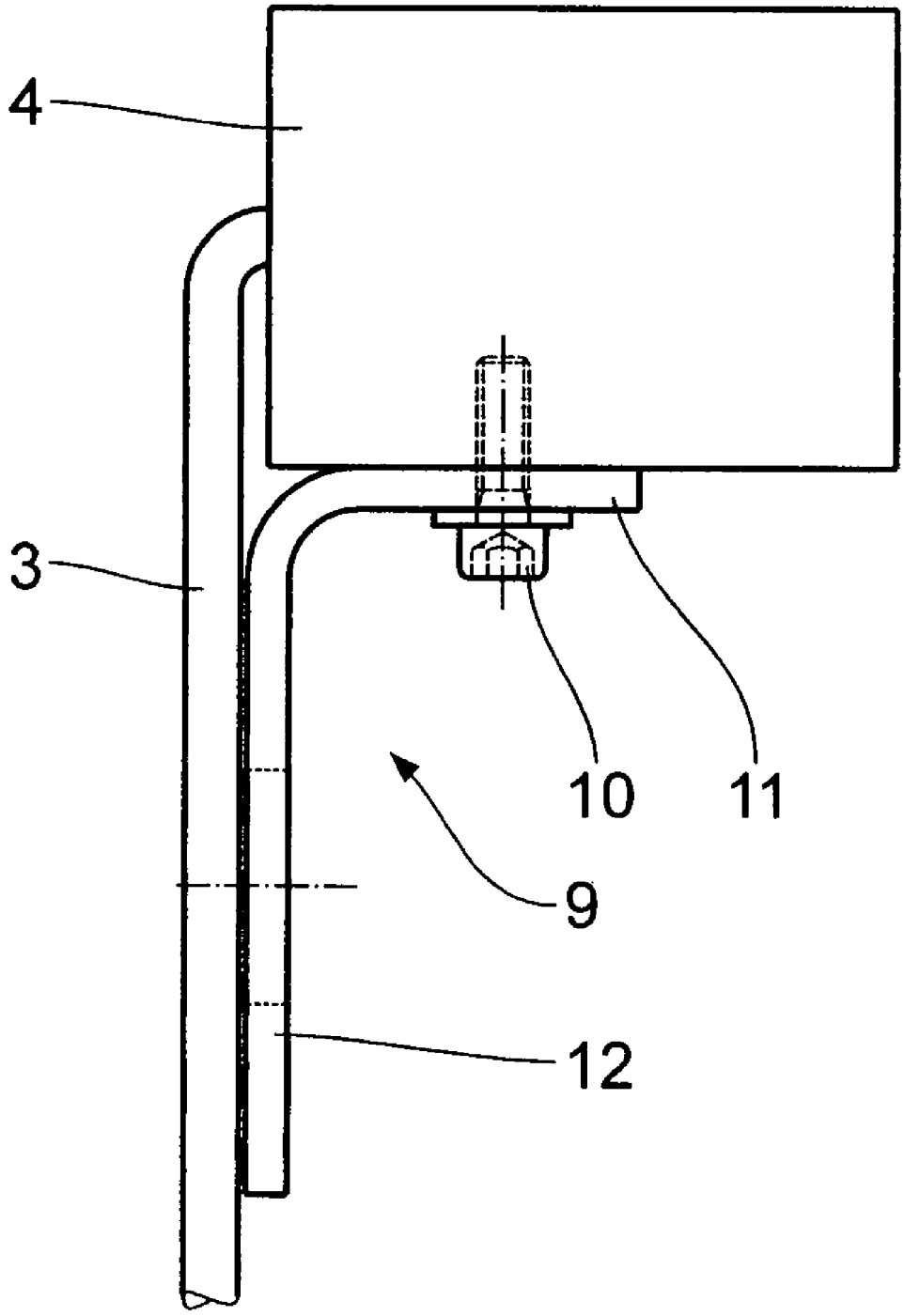
FIG. 2 shows a section through the end region of a wire with the associated damping element.

Depicted in the drawing is a cajon according to the invention comprising a cuboid housing 1, one side of which is designed as the playing side 2, the corresponding wooden plate having been removed in the drawing.

For producing a so-called snare effect, wires 3 extend parallel to the playing surface, that is the corresponding wooden plate, said wires being fixed at their one end to the upper front plate 4 and at their other end to a tension element 5. The tension element 5 is formed by a wooden strip whose distance from the upper front plate 4 is changeable by means of adjusting screws 6, which engage into the lower front plate 7 and can be operated from the underside of the instrument.

The underside 8 of the upper front plate 4, in the ready-to-use condition, has damping elements 9 of L-shaped cross section affixed to it by means of screws such that a first L-shaped leg 11 that is formed in this manner serves for fastening purposes and the second vertical L-shaped leg 12 rests against a given associated wire 3 in order to dampen its vibration movement. Additional correspondingly shaped damping elements 9 are provided on the wooden strip 5 in the region of the lower front plate 7.

What is claimed is:

1. A cajon comprising a cuboid housing made of wood, wherein one side serves as the playing side and wires are strung below the corresponding wooden plate that, when the playing surface is struck, interact with the same and produce a sound effect, wherein each wire (3) has at least one associated damping element (9), wherein the damping elements (9) are composed of a rubbery, flat material, and the damping elements (9) are fixed to a surface (underside 8) extending perpendicular to the wires and are bent at right angles in such a way that the free L-shaped leg (12) that does not serve for fastening purposes elastically rests against the corresponding wire end.

2. A cajon according to claim 1, wherein damping elements (9) are provided in each case at an upper and lower end of each wire (3).

3. A cajon according to claim 1, wherein at least one end of each wire (3) is fixed to a tension element (5), which is displaceable by tension adjustment screws (6) in the longitudinal direction of the wires (3) to adjust their pretension.

4. A cajon according to claim 3, wherein the damping elements (9) are provided in the region of a wire end on the tension element (5)

* * * * *